US007703664B2

(12) United States Patent
Westphal et al.

(10) Patent No.: US 7,703,664 B2
(45) Date of Patent: Apr. 27, 2010

(54) PAPERBOARD CONTAINER HAVING CURVILINEAR PORTION

(75) Inventors: Teddy M. Westphal, Florence, SC (US); Richard A. Osman, Effingham, SC (US); H. Mack Davis, Society Hill, SC (US)

(73) Assignee: Sonoco Development, Inc., Hartsville, SC (US)

( * ) Notice: Subject to any disclaimer, the term of this patent is extended or adjusted under 35 U.S.C. 154(b) by 958 days.

(21) Appl. No.: 10/967,057

(22) Filed: Oct. 15, 2004

(65) Prior Publication Data

US 2006/0081688 A1 Apr. 20, 2006

(51) Int. Cl.
*B65D 3/00* (2006.01)
*B65D 5/46* (2006.01)

(52) U.S. Cl. ..... 229/4.5; 229/117.12; 215/384

(58) Field of Classification Search ..... 229/4.5, 229/5.5, 5.8, 93, 201, 671, 117.12; 220/671; 215/384
See application file for complete search history.

(56) References Cited

U.S. PATENT DOCUMENTS

| | | | | |
|---|---|---|---|---|
| 756,406 | A | 4/1904 | Puddefoot et al. | |
| 1,200,803 | A | 10/1916 | Besozzi | |
| 2,006,143 | A * | 6/1935 | Koch | 229/4.5 |
| 2,327,560 | A * | 8/1943 | Rose | 222/215 |
| 2,363,507 | A | 11/1944 | Dewey | |
| 2,982,458 | A | 5/1961 | Hennion | |
| 3,317,110 | A | 5/1967 | Palmer | |
| 3,370,451 | A | 2/1968 | Schuetz | |
| 3,402,871 | A | 9/1968 | Palmer | |
| 3,407,638 | A | 10/1968 | Greis et al. | |
| 3,503,310 | A | 3/1970 | Goetz | |
| 3,563,408 | A | 2/1971 | Bijvoet | |
| 3,759,203 | A | 9/1973 | Frankenberg | |
| 4,154,082 | A | 5/1979 | Beech | |
| 4,230,235 | A * | 10/1980 | Di Amico | 220/94 |
| 4,453,395 | A | 6/1984 | Takeda et al. | |

(Continued)

FOREIGN PATENT DOCUMENTS

GB 495071 A 11/1938

(Continued)

OTHER PUBLICATIONS

Rigid Paperboard; Packaging World; Oct. 2004; Summit Publishing.

*Primary Examiner*—Nathan J Newhouse
*Assistant Examiner*—Christopher Demeree
(74) *Attorney, Agent, or Firm*—Alston & Bird LLP

(57) ABSTRACT

The present invention relates to composite paperboard containers and methods for making the same. Specifically, the present invention includes a curvilinear container comprising a tubular body formed convolutely or via spiral winding from a single paperboard ply or multiple plies as commonly known in the art. The tubular body includes opposing ends that can be sealed by paperboard, metallic, plastic, or membrane-type end closures so as to preserve the consumable products typically enclosed by the container. The curvilinear container includes a tubular body having a curvilinear portion wherein the diameter of the tubular body varies along the length of the curvilinear portion. A plurality of radially projecting ribs are distributed about the circumference of the curvilinear portion as collection areas for excess tube wall material and thereby accommodate reduction of the tube wall diameter within the curvilinear portion.

9 Claims, 10 Drawing Sheets

U.S. PATENT DOCUMENTS

| | | | | |
|---|---|---|---|---|
| 4,470,290 | A | 9/1984 | Jungesjo | |
| 4,581,003 | A | 4/1986 | Ito et al. | |
| 4,768,392 | A | 9/1988 | Giometti | |
| 5,100,017 | A | 3/1992 | Ishinabe et al. | |
| 5,279,442 | A | 1/1994 | Jentzsch et al. | |
| 5,447,048 | A | 9/1995 | Tanaka et al. | |
| 5,634,367 | A | 6/1997 | Yamada et al. | |
| 5,699,932 | A | 12/1997 | Claydon et al. | |
| 5,762,230 | A * | 6/1998 | Policappelli | 220/62.12 |
| 5,899,355 | A | 5/1999 | Claydon et al. | |
| 6,012,601 | A | 1/2000 | Van Dam | |
| 6,422,455 | B1 * | 7/2002 | Cahill et al. | 229/201 |
| 6,540,132 | B1 | 4/2003 | Lowry et al. | |
| 6,595,409 | B2 * | 7/2003 | Hashimoto et al. | 229/108 |
| 2002/0017502 | A1 * | 2/2002 | Renz | 215/384 |
| 2004/0056080 | A1 * | 3/2004 | Johansson et al. | 229/4.5 |

FOREIGN PATENT DOCUMENTS

| | | | |
|---|---|---|---|
| JP | 52 90373 | A | 7/1977 |
| JP | 08 072850 | | 3/1996 |
| WO | WO 02/49834 | A1 | 6/2002 |

* cited by examiner

PAPERBOARD CONTAINER HAVING CURVILINEAR PORTION

BACKGROUND OF THE INVENTION

1. Field of the Invention

The invention relates generally to consumer product containers, and more particularly to consumer product containers having a curvilinear portion such that the diameter of the container varies along the length of the curvilinear portion. In addition, the invention relates to various methods of making consumer products containers having at least one curvilinear portion.

2. Description of Related Art

Consumer food and drink products and other perishable items are often packaged in known tubular composite containers 10 of the type depicted in FIG. 1. These containers 10 are comprised of a tubular body 15 that is sealed at both ends. As shown in FIG. 2, the tubular body 15 is conventionally formed of at least one paperboard body ply 30 that is wrapped around a mandrel to create a tubular structure. The body ply 30 may be spirally wound or convolutely wrapped around the mandrel. Composite containers 10 may also include a liner ply 32 adhered to the interior surface of the body ply 30. Liner plies 32 are typically comprised of an impervious material so as to ensure that (a) products packaged within the container do not leak from the container, and (b) air, water, or other environmental contaminants do not enter the container and thereby spoil or degrade the contents. Composite containers 10 may also include a label ply 35 wrapped around and adhered to the exterior of the body ply 30. Such label plies 35 typically provide consumer information or display a desired product trade dress.

Composite multi-ply containers as described above have been well-received in the marketplace and are now found in use throughout a wide variety of applications. For example, composite containers are used to hold food products such as frozen juices, powdered drinks, bread dough, snack products and the like. In view of this broad usage, it has become apparent that composite containers containing one product must be adequately distinguished from others containing different products. Further, principles of efficiency and marketplace competition suggest the desirability of manufacturing containers that stand out from one another, such that, when placed in a retail display environment a given composite container (and the product enclosed therein) becomes more noticeable.

Markings provided on label plies serve, to some extent, to distinguish the colors or trade dress of competing products; however, color schemes may be copied or simulated and by themselves do not ensure that a given product will stand out. Changing the size of a given container to distinguish a product may not be desirable as such changes generally require modifying the quantity of goods enclosed and further could negatively impact product price. Varying the shape of a composite container to attract consumers is also traditionally problematic. The basic cylindrical (i.e., uniform cross-sectional, straight-sided) shape of composite paperboard containers is generally dictated by the container's primary function (i.e., to package consumer products effectively) and the container's method of construction (i.e., convolute or spiral winding about a mandrel). Changing this basic cylindrical straight-sided shape to produce non-straight-sided containers that can effectively hold products has been possible with certain types of containers such as those formed by blow-molding, injection molding, or the like, but heretofore has not been accomplished with composite containers.

Accordingly, it is desirable to provide a composite paperboard container having enhanced visual distinctiveness in terms of shape, for better consumer recognition. It is also desirable to improve a consumer's ability to grip or manipulate the container when handling. Finally, it is desirable to produce the above containers by adding simple downstream operations and processes entailing relatively little additional expense without modifying the basic apparatus and processes of existing composite container manufacturing lines.

BRIEF SUMMARY OF THE INVENTION

The present invention provides a curvilinear container having a distinctive shape for improved consumer handling and recognition. Such curvilinear containers may be produced by adding relatively inexpensive downstream forming operations and without substantially altering the conventional cost-effective composite tube forming operations known in the art. The curvilinear containers are comprised of a tubular body formed convolutely or via spiral winding from one or more plies composed of various materials as commonly known in the art. The tubular body includes opposing ends that can be sealed by paperboard, metallic, plastic, or membrane-type end closures so as to preserve the consumable products typically enclosed by the container. Advantageously, curvilinear containers according to the present invention include one or more of the additional features described below that enhance their aesthetic appeal, distinctiveness, and ease of handling.

According to one embodiment of the present invention, the curvilinear container includes a tubular body having a curvilinear portion (as viewed from a direction perpendicular to the longitudinal axis of the tubular body) wherein the diameter of the tubular body varies along the length of the curvilinear portion. The curvilinear portion is formed by deforming the composite container body to reduce its diameter over a lengthwise portion of the body. A plurality of radially projecting ribs are distributed about the circumference of the curvilinear portion to serve as collection areas for excess tube wall material and thereby accommodate reduction of the tube wall diameter within the curvilinear portion. According to several embodiments of the present invention, the radially projecting ribs may project inwardly toward the longitudinal axis of the curvilinear container, outwardly away from the curvilinear container, or in both directions such that some ribs project inwardly and others project outwardly. Whether directed inwardly or outwardly, the ribs possess a rib height defined between the apex of the rib and the opposite surface of the non-ribbed portion of the ply. According to several embodiments, the rib height is increased as the diameter of the curvilinear portion of the tubular body is reduced.

According to one embodiment of the invention, the tubular body of the container has a first diameter as originally manufactured on a spiral or convolute winding apparatus. The tubular body includes at least one reduced-diameter portion whose diameter is less than the first diameter. The tubular body transitions between the first diameter and the reduced-diameter at transition areas that bound the opposite ends of the reduced-diameter portion. Advantageously, the opposite ends of the tubular body have the first diameter. In further embodiments of the invention, the tubular body can include two or more reduced-diameter portions axially spaced apart along the body, with a portion of greater diameter (less than or equal to the first diameter) disposed between adjacent reduced-diameter portions, such that the body takes on a wavy appearance in side view.

In another embodiment of the invention, one or more radially projecting handles are distributed about the circumference of the curvilinear portion to allow users a means for grasping the curvilinear container. In one embodiment, the radially projecting handles also provide collection areas for excess tube wall material and thereby accommodate reduction of the tube wall diameter within the curvilinear portion. According to several embodiments of the present invention, the radially projecting handles project outwardly away from the longitudinal axis of the curvilinear container. The handles possess a maximum handle width and define opposed transitions where the handles meet the tubular body. A minimum transition width is defined between the transitions. In one embodiment, the maximum handle width is greater than the minimum transition width to provide handles that are more easily manipulated with one hand. In other embodiments, handles having a maximum handle width that is less than or equal to the minimum handle width may also be provided.

As referenced above, the curvilinear containers of the present invention can be produced from containers made on standard composite container assembly lines as known to one of ordinary skill in the art. As described in detail below, however, various embodiments of the present invention include the addition of at least one novel forming operation conducted downstream of the basic composite container manufacturing process.

According to one embodiment of the present invention, the curvilinear container is a composite container having a non-straight sided shape when viewed from a side view, or a direction perpendicular to the longitudinal axis of the container. According to this embodiment, the non-straight sided composite container may be produced by a method comprising the steps of: providing a composite paperboard tube of circular cylindrical cross section having a first diameter and a side wall; deforming a partial lengthwise section of the composite paperboard tube radially inwardly to reduce the diameter of the composite tube below the first diameter and impart a curvilinear shape to the side wall as viewed in side view; the deforming step further comprising forming a plurality of circumferentially spaced, longitudinally extending ribs in the side wall in the partial lengthwise section, the ribs projecting radially and each rib having a radial extent that increases as the diameter of the composite paperboard tube decreases, whereby the ribs accommodate the reduction in diameter of the composite paperboard tube.

According to yet another embodiment, a curvilinear container may be produced by a method having the steps of: sleeving a composite paperboard tube comprising a circular cylindrical cross section, a side wall, and a first diameter, over a forming mandrel having a curvilinear form; circumferentially spacing a plurality of rib-forming elements about the composite paperboard tube; driving the plurality of rib-forming elements radially inwardly to deform a partial lengthwise section of the composite paperboard tube radially, inwardly, thereby reducing the diameter of the composite paperboard tube below the first diameter, imparting a curvilinear shape to the side wall as viewed in side view, and forming a plurality of circumferentially spaced, longitudinally extending ribs into the side wall in the partial lengthwise section; and wherein the plurality of ribs project radially and at least one of the ribs have a radial extent that increases as the diameter of the composite paperboard tube decreases, whereby the at least one of the ribs accommodates reduction in diameter of the composite paperboard tube. In one embodiment, one or more cam mechanisms may be employed to drive the plurality of teeth into the composite paperboard tube. In another embodiment, a linear electronic actuator may be used. In other embodiments, pneumatic or hydraulic cylinders may be employed or other similar means as known to one of ordinary skill in the art.

According to one embodiment of the present invention, the curvilinear container may include one or more handle portions. According to this embodiment, the non-straight sided composite container may be produced by a method comprising the steps of: providing a composite paperboard tube of circular cylindrical cross section having a first diameter, the composite paperboard tube having a side wall; deforming a partial lengthwise section of the composite paperboard tube radially inwardly to reduce the diameter of the composite paperboard tube below the first diameter and impart a curvilinear shape to the side wall as viewed in side view; the deforming step further comprising forming at least one longitudinally extending and radially projecting handle in the side wall within the partial lengthwise section. In another embodiment, the deforming step further comprises forming a plurality of circumferentially spaced, longitudinally extending ribs in the side wall in the partial lengthwise section. In various other embodiments, curvilinear containers according to the present invention may be produced by various other techniques as discussed detail below.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
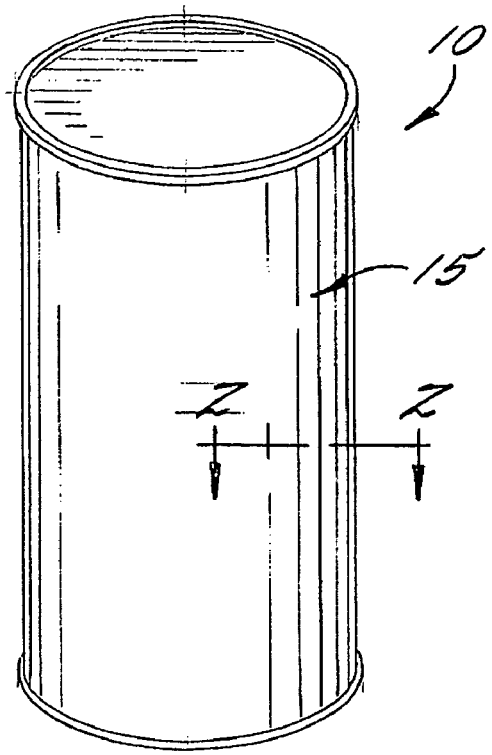
Fig. 1. (PRIOR ART)
FIG. 1 is a perspective view illustrating a prior art tubular composite container.
Figure 2:
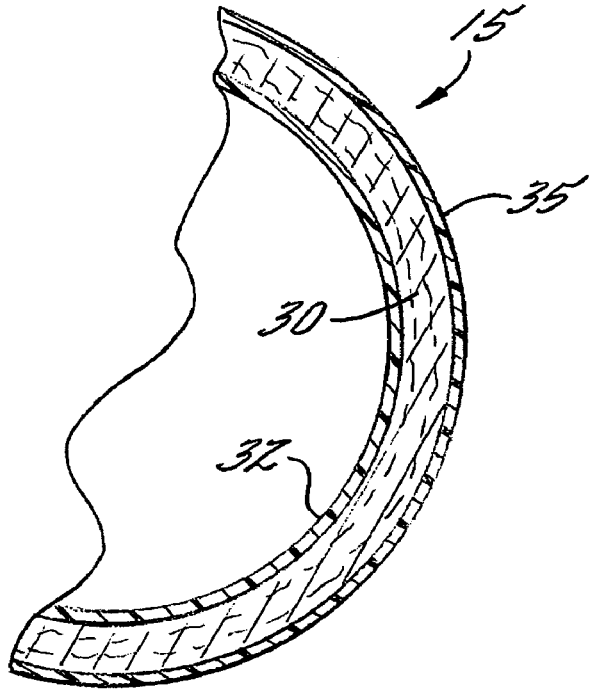
Fig. 2. (PRIOR ART)
FIG. 2 is a section view of a prior art tubular composite container, taken along section line 2-2 of FIG. 1.
Figure 3A:
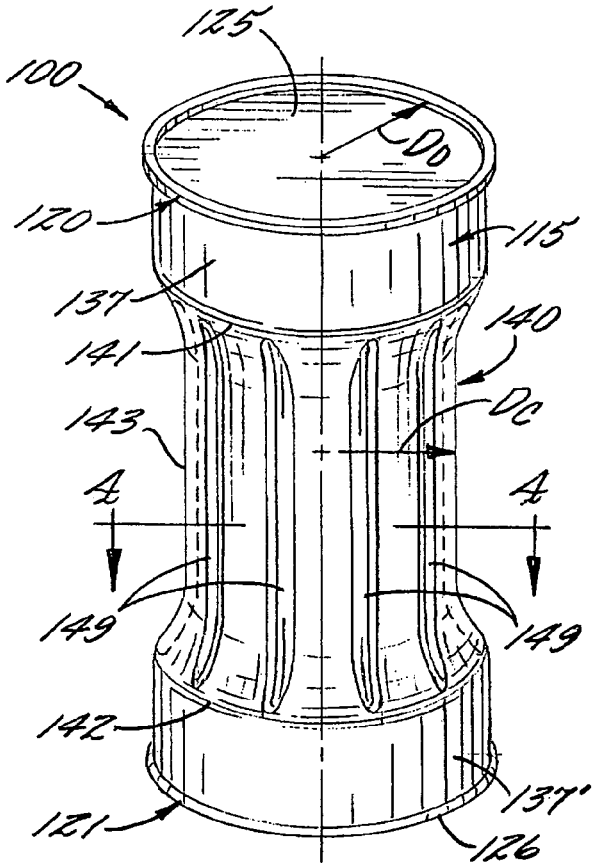
FIG. 3A is a perspective view of a tubular composite container having a curvilinear portion, in accordance with one embodiment of the present invention.

Referring to FIG. 3A there is illustrated a curvilinear container 100, in accordance with one embodiment of the present invention. According to this embodiment, the curvilinear container 100 includes a composite tube 115 having first and second opposed ends 120, 121. Typically, the curvilinear container 100 is sealed to preserve the freshness of the food or other products contained therein. In this regard, the curvilinear container 100 at its top end may include a re-closable cap 125 made from plastic or other materials, and a flexible membrane lid (not shown) sealed to the top end and covered by the cap as known in the art. The second end 121 of the composite tube 115 can be closed by a plastic or metal end closure 126. Various other end closures may also be used, depending upon the type of food product to be packaged such as, for example, frozen concentrated juice.

According to several embodiments of the present invention, the composite tube 115 of the curvilinear container 100 includes a non-straight sided or curvilinear portion 140 and two or more straight-sided or non-curvilinear portions 137, 137'. The term "curvilinear" is used in the specification and claims to denote the fact that at least part of the tubular container body is reduced in diameter relative to its nominal diameter as originally wound on a spiral or convolute winding apparatus. The terms does not necessitate that any part of the body wall have a curved shape in side view, although such may be the case. According to the embodiment illustrated in FIGS. 3A, 3B and 4, the diameter of the curvilinear portion $D_c$ varies along its length and the diameter of the non-curvilinear portion $D_o$ corresponds to the diameter of the composite tube 115 as originally manufactured. The curvilinear portion 140 includes opposing transitions 141, 142 and a median region 143 of reduced diameter defined therebetween. According to the depicted embodiment, the diameter of the curvilinear portion $D_c$ is gradually reduced beginning at the opposing transitions 141, 142 that form the boundaries of the curvilinear portion 140. According to the illustrated embodiment, a single reduced-diameter portion 143 is provided in the curvilinear portion 140 of the composite tube 115; however, in alternate embodiments (not shown), two or more reduced-diameter portions (interspersed with regions of relatively greater diameter) may be provided along the length of the curvilinear portion 140, thereby producing a wavy tube wall surface (as depicted in FIG. 3B) rather than the hour-glass configuration depicted in FIG. 3A.

In one embodiment, the non-curvilinear regions 137, 137' are adjacent the opposed ends 120, 121 of the composite container. Specifically, a first non-curvilinear region 137 is defined between the first end 120 and the first transition 141. As referenced above, the first transition 141 marks the beginning of the container's curvilinear portion 140. The second non-curvilinear portion 137' is defined between the second transition 142, marking the end of the curvilinear region 140, and the second end 121 of the composite tube 115. According to one embodiment, the non-curvilinear regions 137, 137' of the composite tube 115 include diameters $D_o$ that are substantially uniform along their length.

Figure 3B:
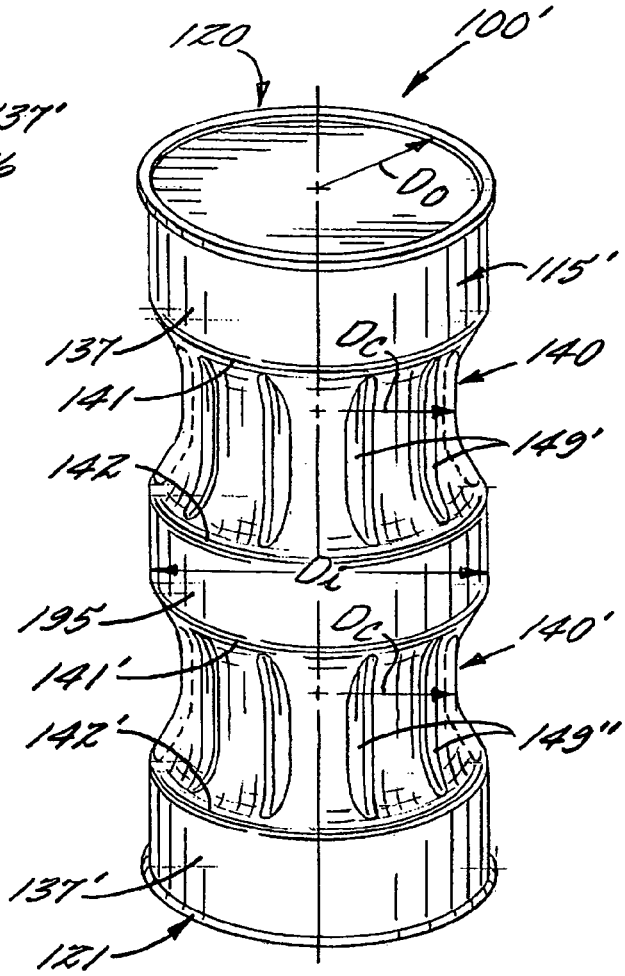
FIG. 3B is a perspective view of a tubular composite container having two curvilinear portions, in accordance with one embodiment of the present invention.

In one embodiment, as referenced above, a curvilinear container 100' according to the present invention may include a first curvilinear portion 140 and a second curvilinear portion 140' as shown in FIG. 3B. Disposed between the first and second curvilinear portions 140, 140' is an intermediate region 195. In one embodiment, the intermediate region 195 may have a substantially uniform diameter $D_i$ as shown, or alternatively, the diameter of the intermediate region $D_i$ may decrease from a centrally disposed apex (not shown) as the intermediate region transitions into the axially adjacent first and second curvilinear portions 140, 140'. The latter embodiment may be particularly advantageous when the radius of the transition between curvilinear 140, 140' and intermediate portions 195 is increased to avoid splitting or tearing of the tube wall 115' and when producing the curved or wavy tubular shape referenced above. In other embodiments, multiple additional curvilinear portions may be added as known to one of ordinary skill in the art.

Figure 4:
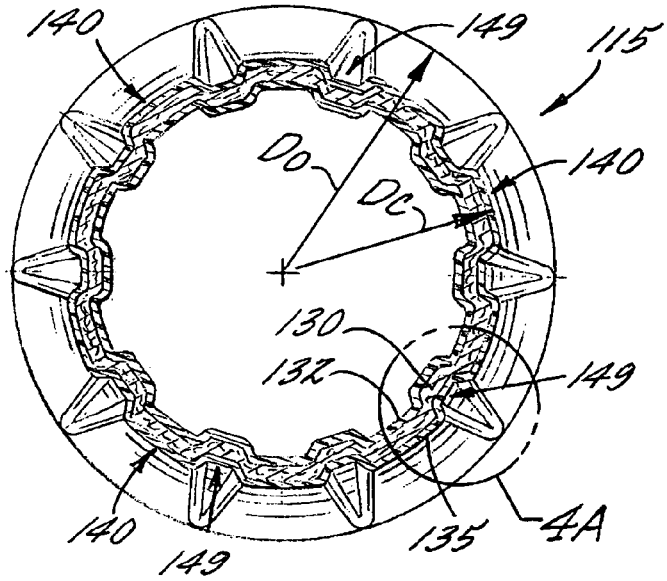
FIG. 4 is a section view of a tubular composite container having a curvilinear portion in accordance with one embodiment of the present invention, taken along section line 4-4 of FIG. 3.
Figure 4A:
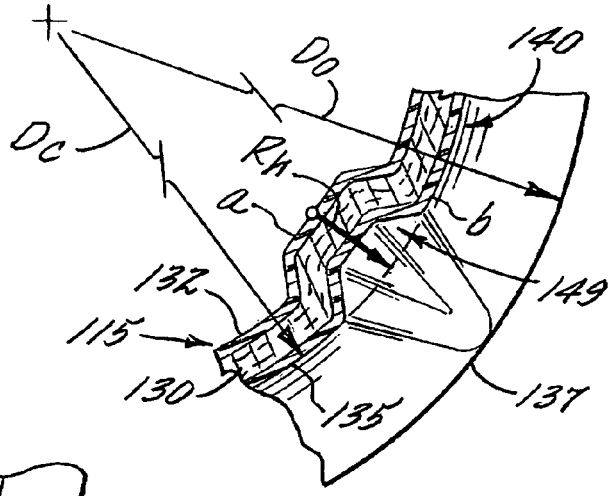
FIG. 4A is a detail view of a rib defined by the body ply of a tubular composite container having a curvilinear portion, in accordance with one embodiment of the present invention.
Figure 4B:
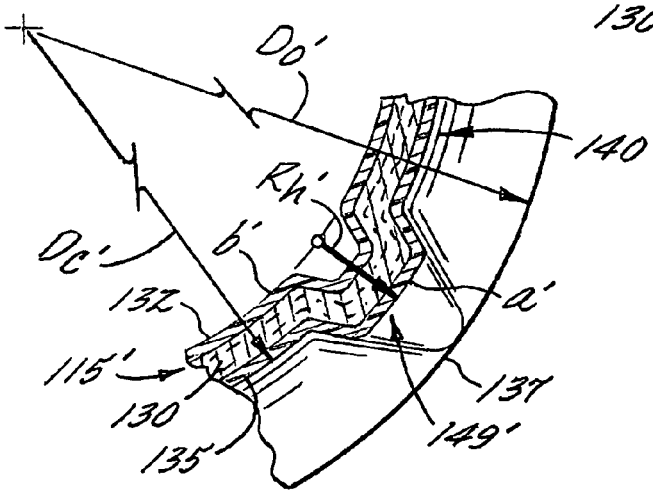
FIG. 4B is a detail view of an outwardly directed rib defined by the body ply of a tubular composite container having a curvilinear portion, in accordance with one embodiment of the present invention.

Regardless of whether one or many curvilinear portions are employed, curvilinear containers 100, 100' according to several embodiments of the invention include a series of circumferentially arranged and radially projecting ribs 149, 149', 149" disposed substantially within the one or more curvilinear portions 140, 140'. In one embodiment, as illustrated in FIG. 3A, the radially projecting ribs 149 extend axially along the length of the curvilinear portion 140. The radially projecting ribs 149 function, in part, as collection areas for excess tube wall material produced as the diameter $D_c$ of the composite tube 115 is reduced within the curvilinear portion 140. As illustrated in FIGS. 4, 4A and 4B, according to various embodiments, the rib height $r_h$ at any given point along the length of the curvilinear portion 140 is related to the reduction of the curvilinear portion diameter $D_c$ relative to the non-curvilinear portion diameter $D_o$. As shown in detail FIGS. 4A and 4B, the rib height $r_h$, $r_h'$ of a ply is the height (or depth) that the apex of the rib a, a' extends radially relative to the opposite surface of the non-ribbed portion of the ply b, b'. Notably, the rib height $r_h$, $r_h'$ (or depth) increases as the diameter of the curvilinear portion $D_c$ is reduced. As a result, the diameter of the composite tube 115 may be reduced along its curvilinear portion 140 in such a manner that the tube wall material is not compressed or stretched. Said differently, the total circumferential length of the tube wall material about the curvilinear portion 140 is substantially equal to the circumference of the non-curvilinear portion 137, 137' of the composite tube 115.

FIG. 4 illustrates one embodiment of the present invention wherein the composite tube 115 comprises a body ply 130 formed of paperboard material, a liner ply 132 adhered to the inner surface of the body ply 130, and a label ply 135 adhered to the outer surface of the body ply 130. As referenced above, a plurality of radially projecting ribs 149 are distributed about the circumference of the composite tube 115. Although FIG. 4 depicts the ribs 149 formed in a body ply 130, liner ply 132, and label ply 135 multiple other configurations are possible as known to one of ordinary skill in the art. For example, the ribs 149 may be formed through a plurality of additional body plies (not shown) in embodiments where increased container thickness or strength is desired. Alternatively, in other embodiments, rib 149 formation may be limited to one or more body plies 130, for example, in applications where liner or label plies 132, 135 are loosely attached or omitted altogether.

In addition, the plurality of radially projecting ribs 149 need not be uniformly distributed about the circumference of the composite tube 115 as depicted in FIG. 4A. For example, in various embodiments, the radially projecting ribs 149 may be distributed about the circumference of the composite tube 115 non-uniformly (i.e., such that the distance between ribs varies from one rib to the next), or partially uniform and non-uniform depending on the desired shape of the curvilinear portion 140.

According to various embodiments of the present invention, the radially projecting ribs 149 may be formed to project inwardly (i.e., toward the longitudinal axis of the composite tube) as shown in FIG. 4A or outwardly 149' (i.e., away from the longitudinal axis of the composite tube) as shown in FIG. 4B. Either orientation allows the ribs 149, 149' to serve their primary function, that is, to provide collection areas for excess tube wall material thereby facilitating a reduction in tube diameter. The ribs 149, 149' also provide a tactile gripping surface for easy manipulation of the curvilinear container 100 by consumers.

Figure 5:
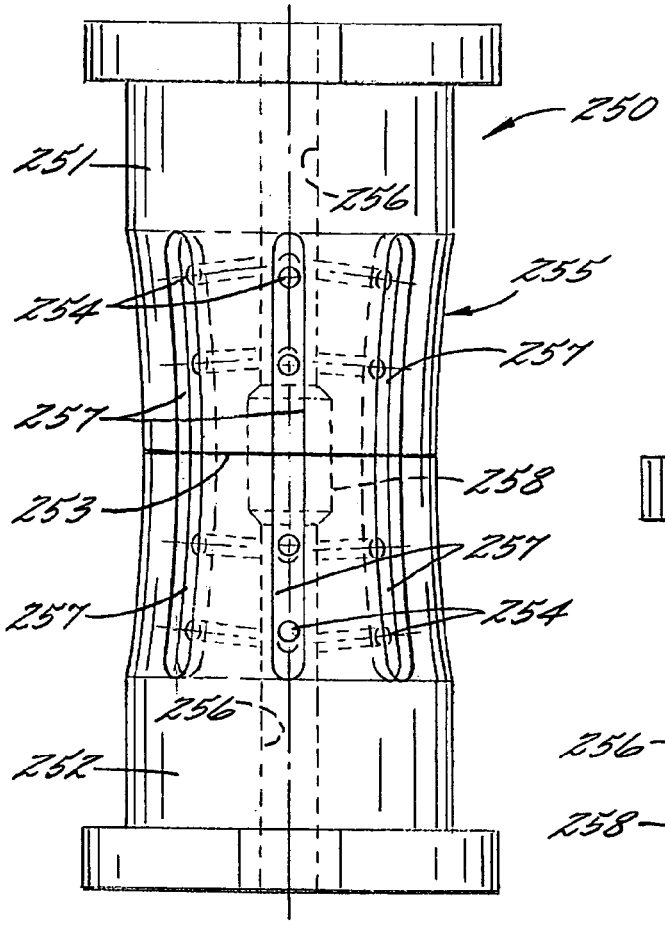
FIG. 5 is a perspective view of a forming mandrel in accordance with one embodiment of the present invention.
Figure 6:
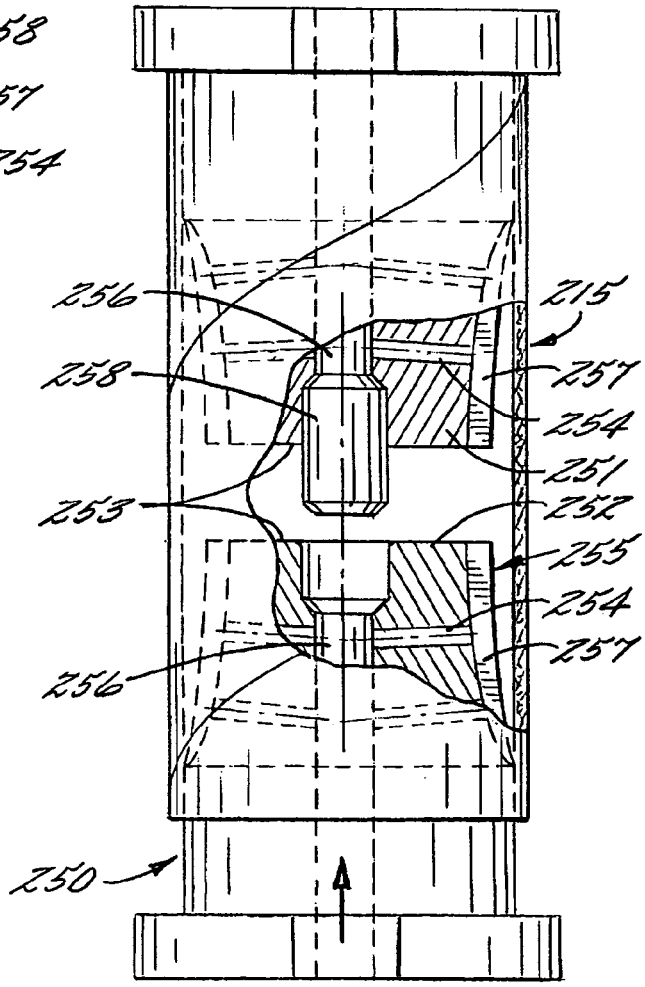
FIG. 6 is a perspective view of a composite paperboard tube sleeved over a forming mandrel in accordance with one embodiment of the present invention.
Figure 7:
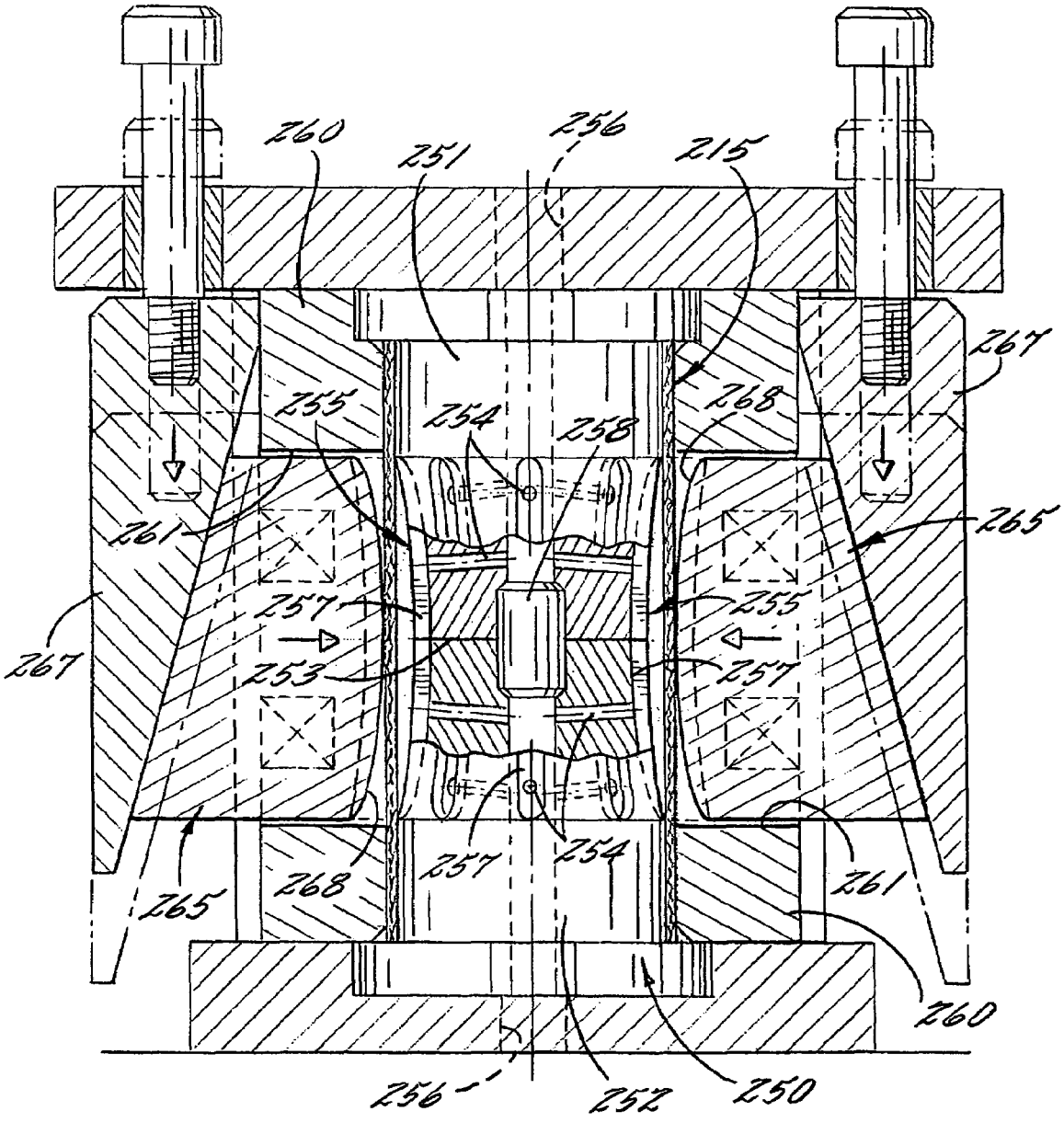
FIG. 7 is a side, partially sectioned view of a method for forming the curvilinear portion of a curvilinear container in accordance with one embodiment of the present invention.

FIGS. 5, 6 and 7 illustrate a method for making curvilinear containers in accordance with one embodiment of the present invention. The illustrated method includes providing a forming mandrel 250 as shown in FIG. 5. The forming mandrel 250 defines a curvilinear form 255 having a plurality of circumferentially spaced grooves 257 extending radially, inwardly, within the curvilinear form 255 as shown. In another embodiment, the forming mandrel may include a plurality of ribs extending radially, outwardly, within the curvilinear form (not shown). As apparent to one of skill in the art, mandrels having inwardly directed grooves are used to produce inwardly projecting ribs (as shown in FIG. 4A) while mandrels having outwardly directed ribs produce curvilinear containers having outwardly directed ribs (as shown in FIG. 4B).

In one embodiment, the forming mandrel 250 is a separable forming mandrel having a first part 251 and a second part 252 separated by a part line 253 as shown. A composite tube 215 having one or more plies (e.g., body ply, liner ply, label ply, etc.) is sleeved over the forming mandrel 250 as shown in FIG. 6. In embodiments having separable forming mandrels, the first part 251 may be separated from the second part 252 to accommodate sleeving of the composite tube 215 as will be apparent to one of ordinary skill in the art. In another embodiment, the composite tube 215 is positioned to completely cover the curvilinear form 255 of the forming mandrel 250.

Once the composite tube 215 has been positioned over the forming mandrel 250, the method includes disposing a plurality of rib-forming elements 265 circumferentially around the composite tube/forming mandrel assembly as shown in FIG. 7. The rib-forming elements 265 are shaped to complement the curvilinear form 255 of the first forming mandrel 250, that is, they include curvilinear contact surfaces 268 having a contour, width, and height configured to be substantially received by grooves (or configured to receive ribs) defined by the first forming mandrel 250. The plurality of rib-forming elements 265 are positioned adjacent the forming mandrel 250 and spaced circumferentially about the forming mandrel 250 to align with the circumferentially spaced grooves 257 (or ribs). The plurality of rib-forming elements 265 are driven radially inwardly to deform the tube wall into the opposing grooves 257 (or around the outwardly projecting ribs) of the forming mandrel 250, thereby deforming the composite tube 215 and creating a curvilinear portion 255 having a plurality of inwardly projecting (or outwardly projecting) ribs formed therein.

In the depicted embodiment, the plurality of rib-forming elements 265 are supported circumferentially around the composite tube 215 by a housing 260. In one embodiment, the housing 260 defines a plurality of circumferentially spaced apertures 261 for receiving the plurality of rib-forming elements 265. The apertures 261 are aligned with the circumferentially spaced grooves 257 (or ribs) such that the rib-forming elements 265 can be driven inwardly, through the plurality of apertures 261, to deform the tube wall into the opposed grooves 257 (or around the outwardly projecting ribs) of the forming mandrel 250. In one embodiment, the housing 260 includes a sufficient thickness such that the plurality of apertures 261 define a plurality of channels for supporting the rib-forming elements 265 as they translate through the apertures 261. In one embodiment, the plurality of rib-forming elements 265 are supported along at least a portion of their length by the plurality of channels and thereby prevented from deflecting off-line prior to being received by the grooves 257 (or receiving the ribs) of the forming mandrel 250.

In various embodiments, the rib-forming elements 265 may be driven into the grooves 257 or around the ribs (not shown) of the forming mandrel 250 simultaneously or non-simultaneously by a variety of driving devices 267. For example, in one embodiment, one or more of the plurality of rib-forming elements 257 may be driven into the grooves 257 or around the ribs (not shown) of the forming mandrel 250 by a cam mechanism as shown. Various pneumatic, hydraulic, electromagnetic or other similar mechanical means may be used to drive the toothed members 265 into the grooves 257 of the forming mandrel 250, as will be apparent to one of ordinary skill in the art.

In another embodiment, one or more vent ports 254 may be provided within the curvilinear form 255 of the forming mandrel 250. Such vent ports 254 allow air caught between the composite tube 215 and the forming mandrel 250 to escape through an exit port 256 as the plurality of rib-forming elements 265 deform the composite tube inwardly against the forming mandrel 250. The vent ports 254 may produce a more evenly formed tube 215 by reducing the potential for air pockets between the tube and forming mandrel.

In embodiments having a separable forming mandrel 250 (as shown), the formed composite tube 215 may be ejected from the forming mandrel 250 by retracting one or both of its first and second parts 251, 252. Although depicted specifically with regard to the embodiment described by FIG. 7, it is noted that this method of ejection of a formed curvilinear tube is not limited to the depicted embodiment and may be used in conjunction with many of the embodiments disclosed by the present specification and appended claims.

Figure 8:
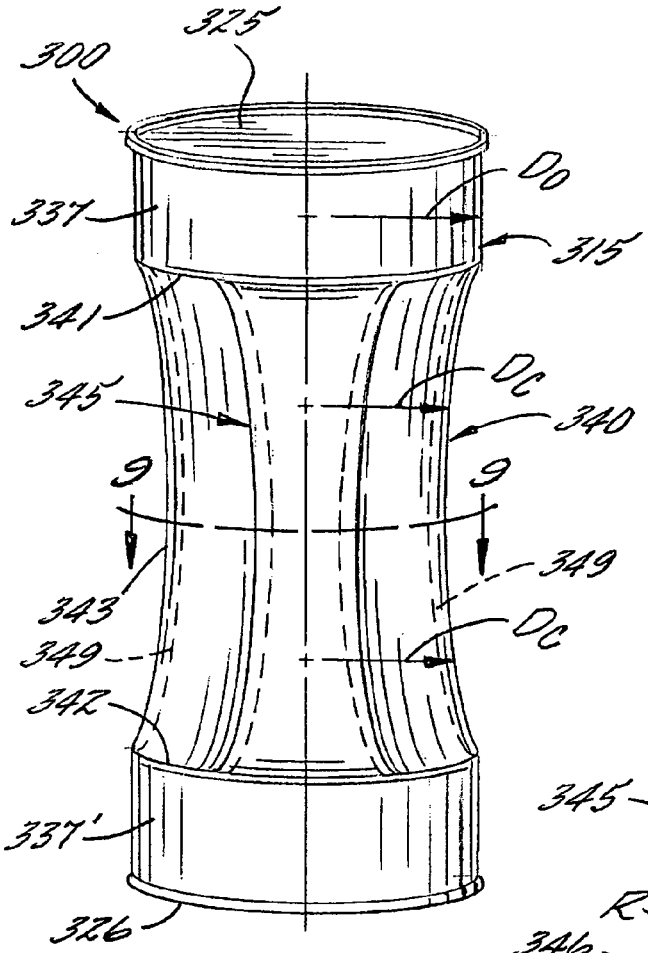
FIG. 8 is a perspective view of a curvilinear container having outwardly directed handles extending axially within the curvilinear portion of the composite tube according to one embodiment of the present invention.

Referring to FIG. 8, there is illustrated a curvilinear container 300 in accordance with yet another embodiment of the invention. According to the depicted embodiment, the curvilinear container 300 includes a composite tube 315 having one or more handles 345 formed within a curvilinear portion 340. Just as with the prior embodiments, curvilinear tubes 300 according to the present embodiment are sealed to preserve the freshness of the food or other products and, thus, may include the re-closable cap, flexible membrane lid, and plastic or metal end closures of the type depicted in FIG. 3A.

As shown in FIG. 8, curvilinear containers 300 according to the depicted embodiment include a composite tube 315 having a curvilinear portion 340 and two or more non-curvilinear portions 337, 337'. The curvilinear portion 340 includes opposed transitions 341, 342 and a median region 343 of reduced diameter defined therebetween. The diameter of the curvilinear portion $D_c$ varies along its length. The diameter of the non-curvilinear portions $D_o$ correspond generally to the diameter of the composite tube 315 as originally manufactured, i.e., prior to the curvilinear forming operations described below.

In another embodiment, one or more handles 345 are defined in the curvilinear portion 340 of the curvilinear containers 300. The handles 345 are configured to extend axially within the curvilinear portion 340 of the composite tube 315 as shown. In various embodiments, the handles 345 project radially, outwardly from the curvilinear portion 340 of the composite tube such that a user is able to grasp the one or more handles 345 and manipulate the curvilinear container 300. In addition to the one or more handles 345, various embodiments of the invention may include one or more radially projecting ribs 349 as referenced in the embodiments above and described in further detail below.

Figure 9A:
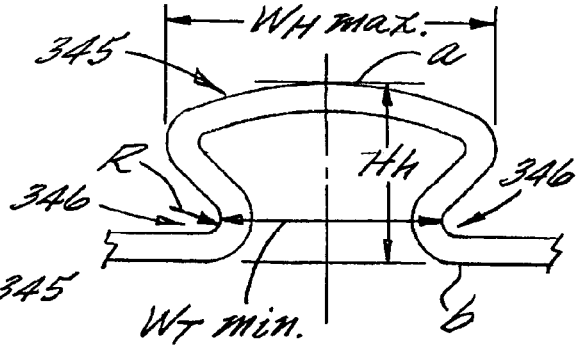
FIG. 9A is a detail view of one of the handles shown in FIG. 9, taken along detail circle 9A.
Figure 9:
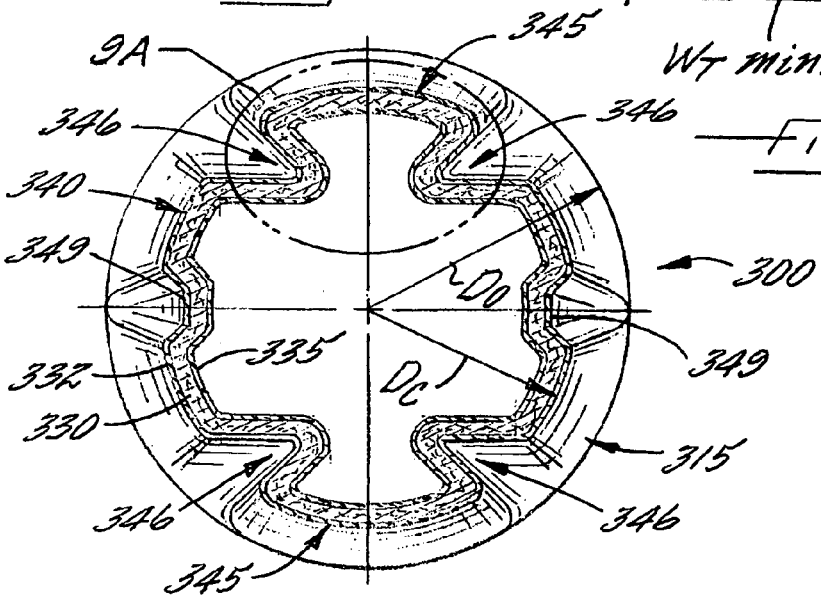
FIG. 9 is a section view of the curvilinear container of FIG. 8, taken along section line 9-9.

FIG. 9 is a section view of the curvilinear container depicted in FIG. 8, taken along section lines 9-9. In the depicted embodiment, each handle 345 is defined by two transitions 346 disposed at either side of the handle 345 as shown. In various embodiments, each handle 345 defines a minimum transition width $W_{Tmin}$, and a maximum handle width $W_{Hmax}$. In the depicted embodiment, the handles 345 are "undercut" such that the minimum transition width $W_{Tmin}$ is less than the maximum handle width $W_{Hmax}$. In such embodiments, the transitions 346 may define a radius R sized to comfortably receive a user's thumb and/or finger tips (e.g., 1/16 inch or more). As will be apparent to one of ordinary skill in the art, undercut embodiments may allow users to more easily "grip" the handles 345 then embodiments wherein the handles are oppositely configured such that the minimum transition width $W_{Tmin}$ is greater than the maximum handle width $W_{Hmax}$ (not shown). Although likely difficult to manipulate with one hand, such "over cut" embodiments may be useful where two-handed manipulation of the curvilinear container is preferred. In either one-handed or two-handed embodiments, the "grip" or ease by which a user may grasp or manipulate the curvilinear container may be enhanced through the use of rough, tacky or other similar materials to coat, cover or comprise the handles, as will be apparent to one of ordinary skill in the art in view of the above disclosure.

Apart from their gripping functionality, handles 345 according to various embodiments of the present invention also serve as collection areas for excess tube wall material produced as the diameter $D_c$ of the composite tube 315 is reduced within the curvilinear portion 340 of the curvilinear container 300. As illustrated in FIGS. 8, 9 and 9A, according to various embodiments, the handle height $H_h$, the minimum transition width $W_{Tmin}$, and the maximum handle width $W_{Hmax}$ at any given point along the length of the curvilinear portion 340 may be related to the reduction of the curvilinear portion diameter $D_c$ relative to the non-curvilinear portion diameter $D_o$. As shown in detail FIG. 9A, the handle height $H_h$, of a ply is the height that the apex of the handle a extends radially relative to the opposite surface of the non-handle portion of the ply b. In various embodiments, at least one of the handle height $H_h$, the minimum transition width $W_{Tmin}$, or the maximum handle width $W_{Hmax}$, increases as the diameter of the curvilinear portion $D_c$ is reduced. In other embodiments, one or more radially projecting ribs 349 may also be provided within the curvilinear region 340 and, thus, provide additional collection areas for excess tube wall material. Accordingly, handles 345 having dimensions (e.g., $H_h$, $W_{Tmin}$, and $W_{Hmax}$) designed for a particular purpose (e.g., ease of grip) may be formed without undue regard for the preferred curvilinear container diameter reduction $D_c$, that is, the handles 345 may be as large or small as desired leaving the ribs 349 to accept excess tube wall material. In each of the above embodiments, the diameter of the composite tube 315 is reduced along its curvilinear portion 340 such that the tube wall material is not compressed or stretched, thus, leaving the total circumferential length of the tube wall material about the curvilinear portion 340 approximately equal to the circumference of the non-curvilinear portion 337, 337' of the composite tube 315.

Although depicted in FIGS. 8 and 9 as uniformly distributed about the circumference of the composite tube 315, the one or more handles 345 and plurality of radially projecting ribs 349 need not be so configured. For example, in various embodiments, the one or more handles 345 and radially projecting ribs 349 may be distributed about the circumference of the composite tube 315 non-uniformly (i.e., such that the distance between handles and/or ribs varies from one handle/rib to the next), or partially uniform and non-uniform depending on the desired shape of the curvilinear portion 340.

Figure 10:
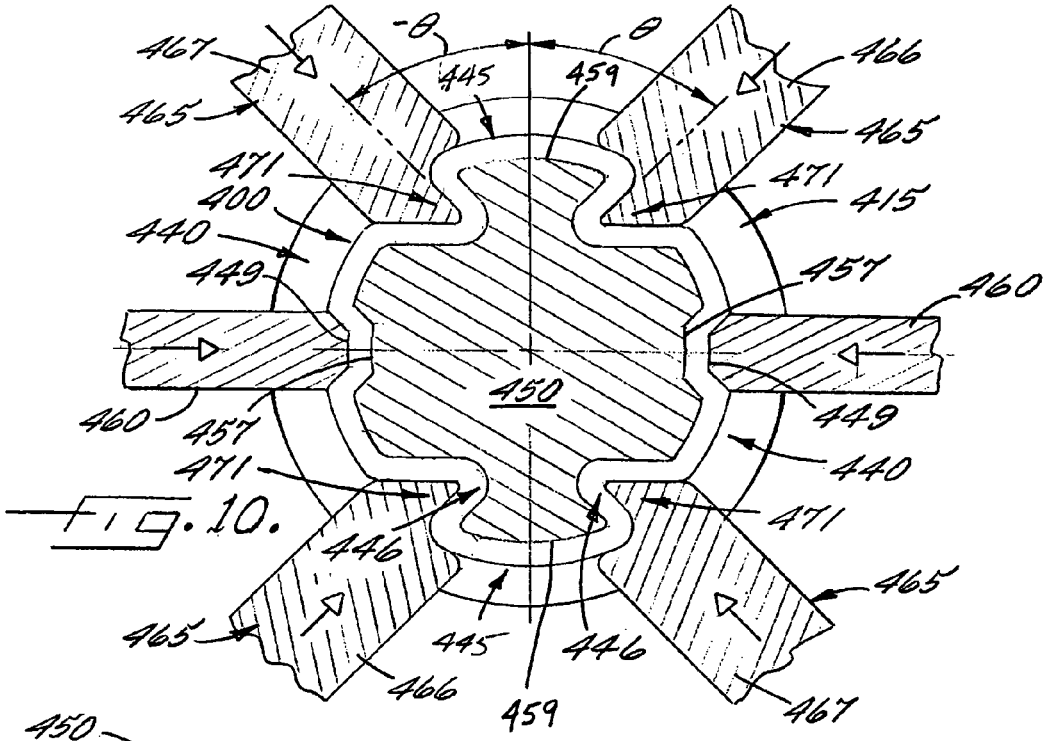
FIG. 10 is a partial section view of a method for forming a curvilinear container having handles in accordance with one embodiment of the invention.
Figure 11:
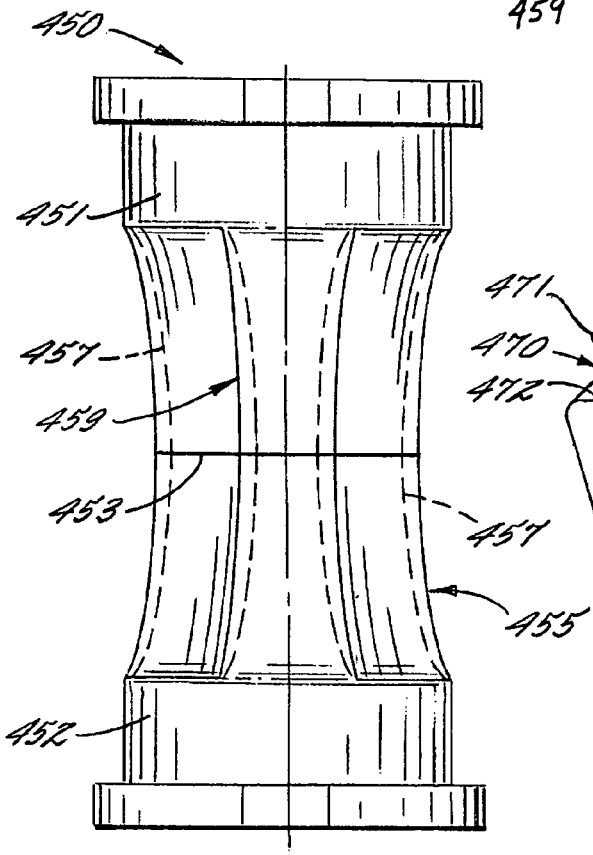
FIG. 11 is a perspective view of a forming a mandrel having handle forms in accordance with one embodiment of the invention.

FIG. 10 illustrates a method for making curvilinear containers 400 in accordance with one embodiment of the present invention. The illustrated method includes providing a forming mandrel 450 as shown in FIG. 11. The forming mandrel 450 defines a curvilinear form 455 having one or more handle forms 459 extending radially, outwardly, from the curvilinear form 455 as shown. In another embodiment, a plurality of circumferentially spaced grooves 457 extending radially, inwardly, may be provided within the curvilinear form 455 as referenced above. In still another embodiment, a plurality of circumferentially spaced ribs (not shown) extending radially, outwardly, may be provided within the curvilinear form 455 as also referenced above. In another embodiment, the forming mandrel 450 is a separable forming mandrel having a first part 451 and a second part 452 divided by a part line 453 as shown. The method further includes providing a composite tube comprised of one or more plies in accordance with known container manufacturing processes. In anticipation of tube forming, the composite tube 415 is sleeved over the forming mandrel 450 such that the composite tube 415 covers the curvilinear form 455 of the forming mandrel 450 as depicted in FIG. 10.

Figure 12:
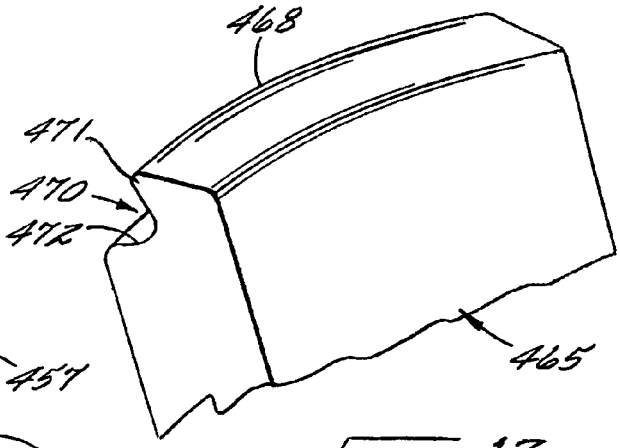
FIG. 12 is a detail view of one of the handle rib-forming elements shown in FIG. 10, taken along detail circle 12.

In the depicted embodiment, at least one pair of handle-forming members 465 are circumferentially disposed around the composite tube/forming mandrel assembly 450. The pair of handle-forming members 465 include first and second handle-forming members 466, 467 disposed radially at opposite angles θ, −θ as shown. The handle-forming members 465 are shaped to complement the one or more handle forms 459 of the first forming mandrel 450. Each handle-forming member 465 defines an s-shaped contact surface 470 as shown in greater detail by FIG. 12. As is best illustrated by FIGS. 10 and 12 collectively, during forming operations the tube wall is captured between the opposed s-shaped contact surfaces of the pair of handle-forming members 465 and the handle form 459, thereby deforming the tube wall and creating a curvilinear portion 440 defining a handle portion 445 therein. The s-shaped contact surfaces 470 are comprised of a convex portion 471 and a concave portion 472. The convex portion 471 forms a handle transition 446 into the composite tube, and the concave portion 472 forms the handle itself into the tube, as will be apparent to one of ordinary skill in the art.

In another embodiment, at least a portion of the s-shaped contact surface 470 of each handle-forming member 466, 467 defines a curvilinear contour 468 along its axial length as shown in FIG. 12. This curvilinear contour 468 contacts and deforms the tube wall 415 radially inwardly into the curvilinear form 455 of the forming mandrel 450. As a result, the tube wall of the curvilinear region 440 that is provided between handles is shaped to possess a curvilinear profile when viewed in side view.

In another embodiment, one or more rib-forming elements 460 may be circumferentially spaced between pairs of handle-forming members 465. As referenced above, the rib-forming elements 460 form radially projecting ribs 449 within the curvilinear portion 440 of the composite tube 415. In various embodiments, the one or more rib-forming elements 460 are driven into complementary grooves 457 or around ribs (not shown), depending on whether inwardly or outwardly directed ribs are preferred. In the present embodiment, the radially projecting ribs 449 combine with the one or more handles 445 to accept excess tube wall material and, thus, define the reduced diameter $D_c$ of the curvilinear portion 440 of the composite tube 415.

In various embodiments, the handle-forming members 465 and the plurality of rib-forming elements 460 may be supported by a cylindrical housing as referenced above. In other embodiments, other similar mechanical support structures may be used. In any of the embodiments referenced above, the handle-forming members 465 and rib-forming elements 460 may be actuated linearly by various pneumatic, hydraulic, electo-magnetic or other similar mechanical means.

Figure 13:
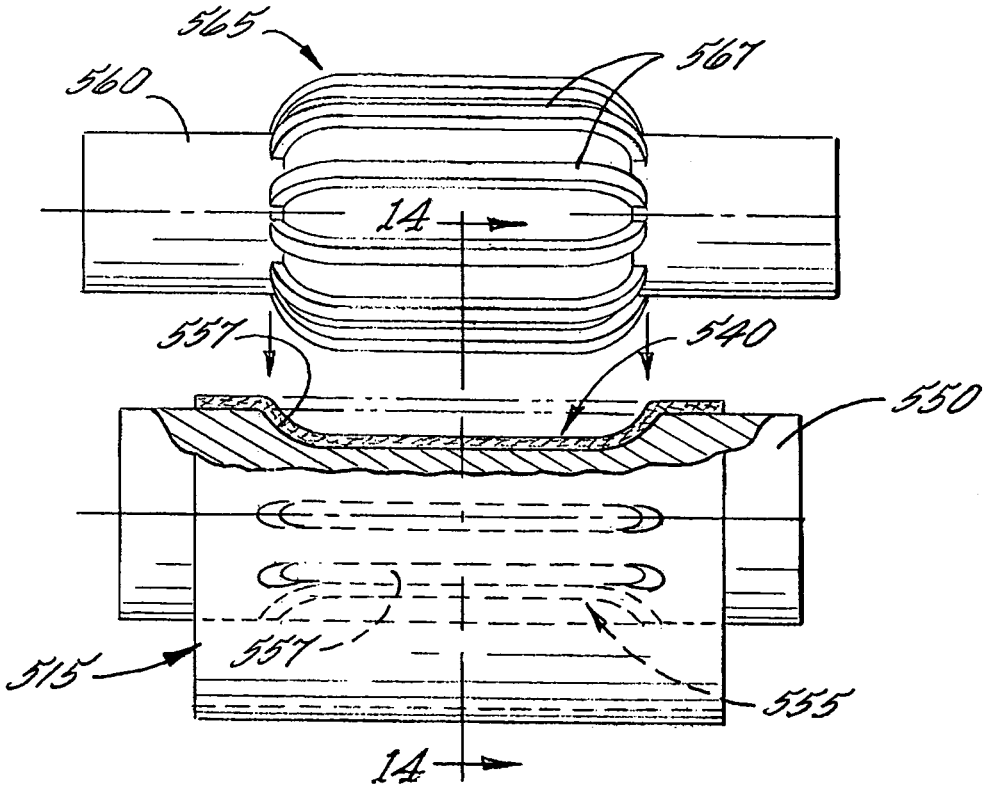
FIG. 13 is a top view of a method for forming the curvilinear portion of a curvilinear container in accordance with one embodiment of the present invention.
Figure 14:
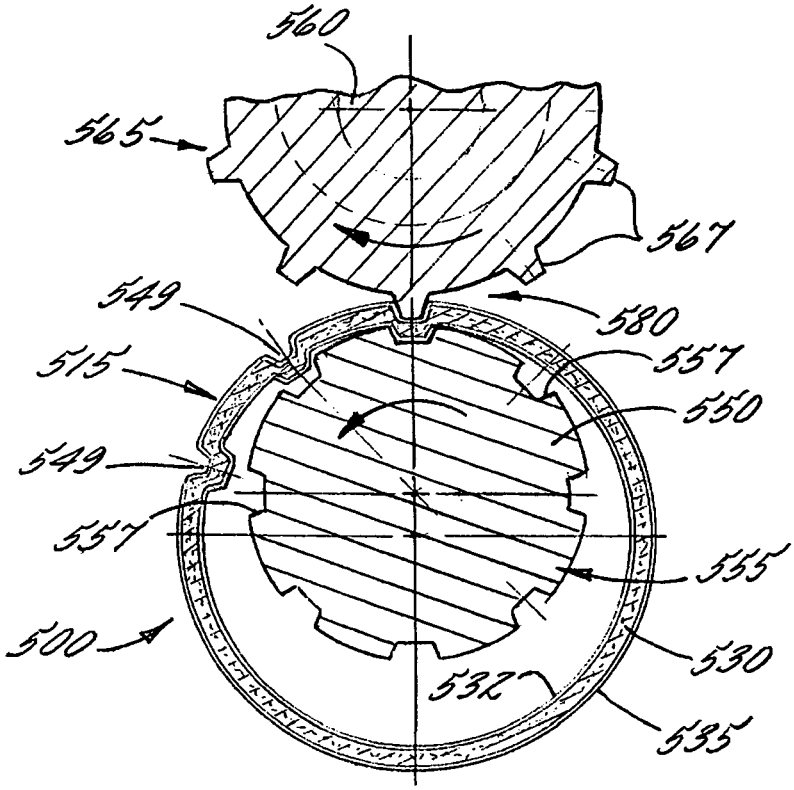
FIG. 14 is a section view of a method for forming the curvilinear portion illustrated in FIG. 13, taken along section line 14-14.

Curvilinear containers 500 according to various embodiments of the invention may be formed via a number of different methods as described below. For example, rotary-type methods are illustrated in FIGS. 13-17. In one embodiment, as shown in FIGS. 13 and 14, the composite tube 515 is rotatably engaged between the forming mandrel 550 and a rotatable second forming mandrel 560 having a complementary curvilinear form 565. The complementary curvilinear form 565 includes a plurality of circumferentially spaced and radially projecting complementary meshing members 567. As shown in FIG. 14, the complementary meshing members 567 are structured in meshing alignment with the meshing members 557 of the first forming mandrel 560 such that the forming mandrels rotate in synchronicity relative to one another. The opposing faces of the curvilinear form 555 of the first forming mandrel 550 and the complementary form 565 of the second forming mandrel 560 are configured to engage one another forming a nip 580 at their point of engagement.

FIG. 14 illustrates the nip point 580 or interference region of the opposing forming mandrels in accordance with one embodiment of the present invention. As the composite tube wall passes through the nip 580, the tube 515 is re-shaped, creating a curvilinear portion 540 that generally matches the contour of the curvilinear form 555 of the first forming mandrel 550. A plurality of radially projecting ribs 549 are formed into the composite tube 515 by the meshing action of the meshing members 557, 567. Although shown in FIG. 14 as comprising a body ply 530, a liner ply 532, and a label ply 535, composite tubes 515 according to other embodiments of the invention may employ multiple other ply configurations as referenced above and known in the art.

In one embodiment, the meshing members 557 of the first forming mandrel 550 include a plurality of circumferentially spaced grooves as shown in FIGS. 13 and 14. According to the depicted embodiment, the grooves are configured to receive a plurality of opposed circumferentially spaced teeth (i.e., complementary meshing members 567) disposed on the second forming mandrel 560. In other embodiments, for example, where outwardly directed ribs are desired, the first forming mandrel may include a plurality of circumferentially spaced teeth (i.e., meshing members) that are configured to engage a plurality of opposed circumferentially spaced grooves (i.e., complementary meshing members) disposed on the second forming mandrel (not shown). Alternatively, in other embodiments, a combination of the above embodiments may be provided wherein the meshing members of the first forming mandrel include a plurality of circumferentially spaced grooves and teeth that are configured to engage a plurality of circumferentially spaced teeth and grooves (i.e., complementary meshing members) disposed on the second forming mandrel (not shown). Additionally, the meshing members and complementary meshing members of the respective forming mandrels need not be uniformly distributed about the circumference of the mandrels as shown. Instead, alternate embodiments of the present invention include meshing members and complementary meshing members that are unevenly distributed about the circumference of their respective curvilinear forms, however, in such embodiments the meshing members remain indexed relative to one another to accommodate meshing rotation. Such non-uniform distributions may be desirable in applications where curvilinear portions are designed to extend only partially around the circumference of a curvilinear container (not shown).

Figure 15:
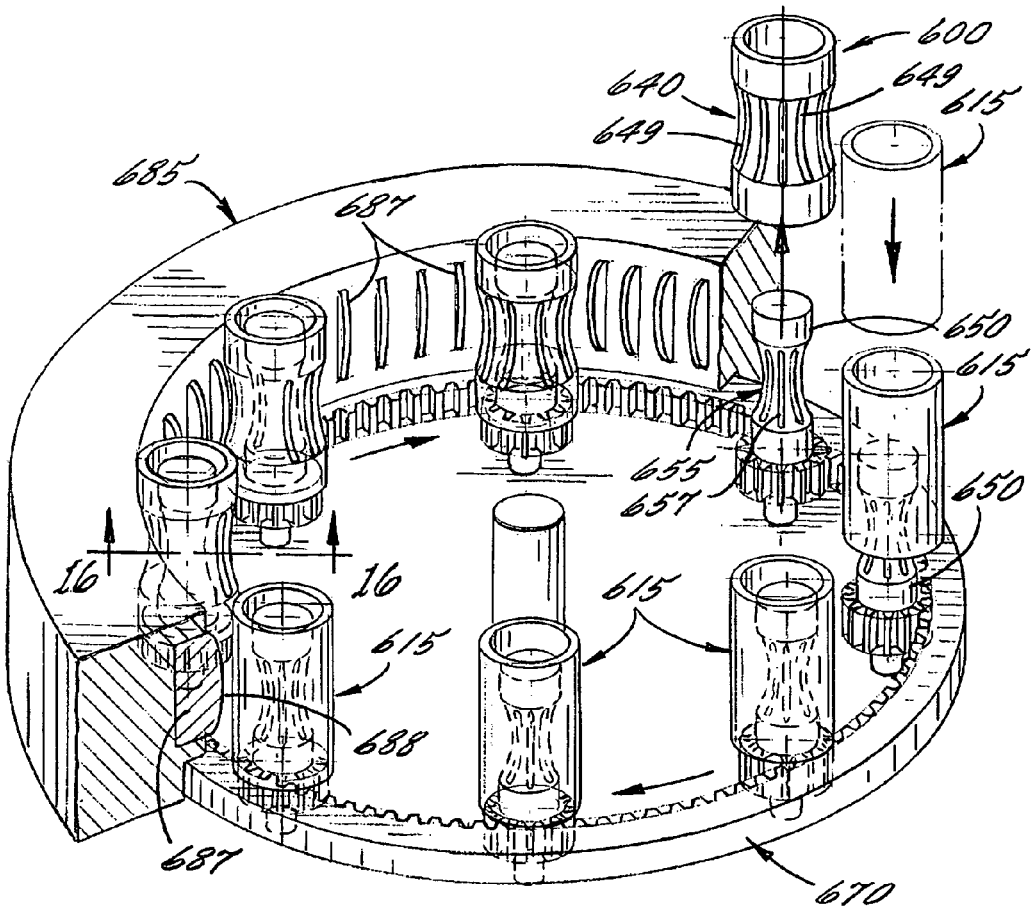
FIG. 15 is a perspective view of a method for forming the curvilinear portion of a curvilinear container using an arcuate forming member in accordance with one embodiment of the present invention.
Figure 16:
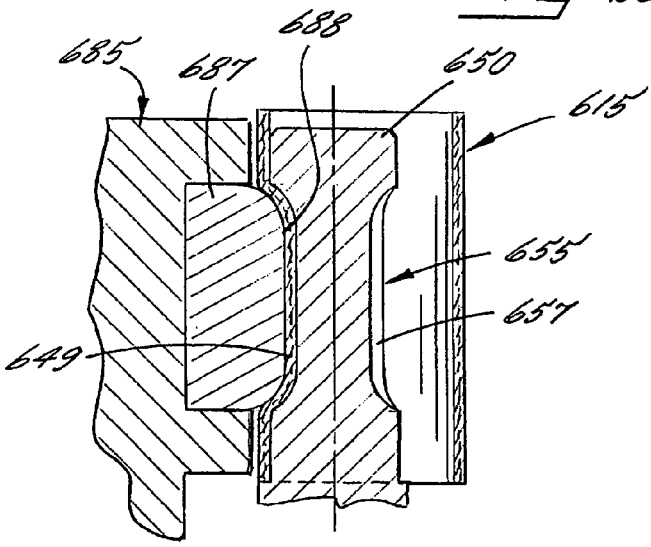
FIG. 16 is a detail view of the interference between the curvilinear teeth of the forming member and the first forming mandrels as provided when shaping the curvilinear portion of the curvilinear container in accordance with one embodiment of the present invention.

FIG. 15 illustrates a method of producing curvilinear containers 600 in accordance with another embodiment of the present invention. In particular, a rotary table or turret 670 is provided that supports a plurality of circumferentially-spaced first forming mandrels 650 at the outer periphery of the turret 670. As noted above, each first forming mandrel 650 is freely rotatable about its longitudinal axis. Composite tubes 615, produced by known processes, are sleeved over the first forming mandrels 650 as shown. The turret 670 positions each first forming mandrel 650 in turn into rotating engagement with an arcuate shaping tool or forming member 685. The first forming mandrels 650 are rotated about their axis in synchronism with the rotation of the turret 670 such that the first forming mandrels 650 drive the composite tubes 615 mounted thereon to roll along the arcuate forming member 685. The arcuate forming member 685 includes teeth 687 for deforming the composite tube 615. As shown in the detail illustration provided by FIG. 16, the teeth 687 include a contact edge 688 shaped to complement the contour of the curvilinear form 655 of the first forming mandrel 650. The teeth 687 are indexed along the arcuate forming member 685 such that their contact edges 688 are in meshing alignment with grooves (i.e., meshing members 657) defined within the curvilinear form 655 of the respective first forming mandrels 650. The contact edges 688 of the teeth 687 have a sufficient surface area such that, as they contact the composite tube 615 the contact edges 688 do not cut or penetrate the paperboard material of the tube 615 and instead deform and re-shape the tube wall to match the contour of the curvilinear form 655 of the first forming mandrels 650. To facilitate this deformation, the teeth 687 drive adjacent portions of the paperboard tube wall into the opposed grooves 687 forming a plurality of inwardly projecting ribs 649. As discussed above, the material deposited within these ribs is necessarily removed from the diameter of the tube and thus, allows the tube diameter to be reduced without tearing or stretching.

Notably, the grooves 657 may, but need not, have a concave interior surface for engaging the contact edges 688 of opposed teeth 687. In fact, the grooves 657 may have any interior configuration so long as they are adequately sized (i.e., sufficient length, width and depth) to receive an opposed tooth 687 in addition to the web of paperboard material that is pressed into the groove 657 during rib forming. Initiating rib formation using insufficiently sized grooves or oversized teeth (i.e., grooves or teeth that do not allow a ply or width of paperboard material on either side of a tooth as it is pressed into a groove) could potentially result in splitting or cutting of the tube wall (not shown).

Figure 17:
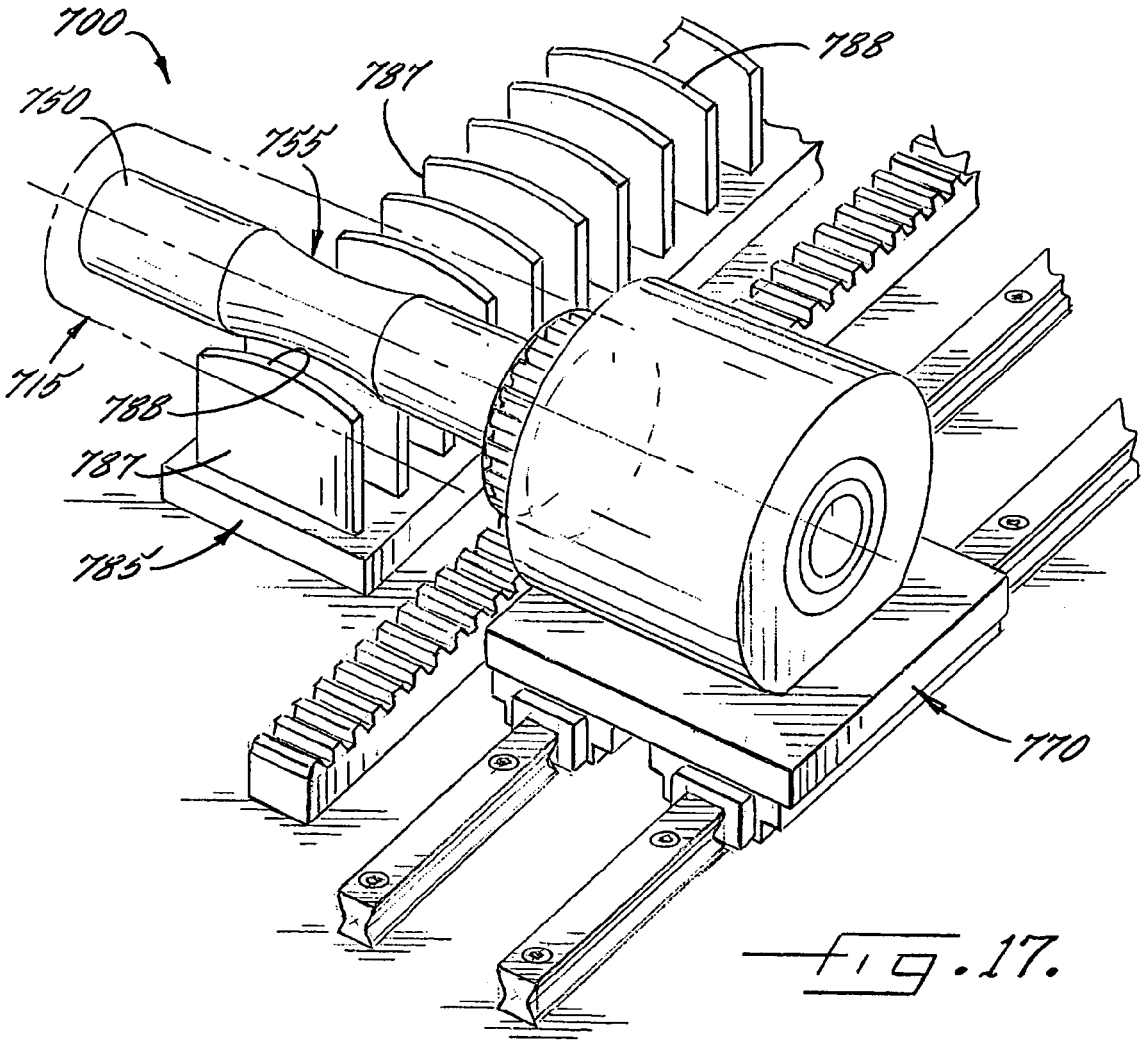
FIG. 17 is a perspective view of a method for forming the curvilinear portion of a curvilinear container using a translating member in accordance with another embodiment of the present invention.

FIG. 17 illustrates a method of producing curvilinear containers 700 in accordance with another embodiment of the present invention. In particular, a translating member 770 is provided that supports at least one first forming mandrel 750. The translating member 770 positions one or more first forming mandrels 750 into rotating engagement with the forming member 785. The first forming mandrels 750 are rotated about their axis as the translating member 770 translates along the length of the forming member 785 such that the first forming mandrels 750 drive the composite tubes 715 mounted thereon to roll along the forming member 785. The forming member 785 may be substantially planar as shown, or in alternate embodiments, may be curved forming arcuate or other similar shapes to conserve manufacturing work space. The forming member 785 includes teeth 787 having contact edges 788 for re-shaping the tubular body 715 as described in reference to FIG. 16 above.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A composite container, comprising:

a tubular body, comprising, at least one body ply formed of a paperboard material and wrapped about a longitudinal axis to form a tubular body wall having a first diameter, said tubular body wall having inner and outer surfaces and opposed first and second ends, a liner ply adhered to the inner surface of said tubular body wall, and a label ply, adhered to at least part of the outer surface of said tubular body wall; and said tubular body defining a curvilinear portion having a diameter that is reduced relative to said first diameter, wherein said curvilinear portion defines at least one axially extending handle projecting radially outwardly, and wherein said handle transitions from a minimum transition width to a maximum handle width when proceeding radially outwardly, and wherein said maximum handle width is larger than the minimum transition width thereby defining an undercut portion that is configured for grasping by a user.

2. A composite container as recited in claim 1, wherein said curvilinear portion further defines at least one circumferentially spaced and radially projecting rib.

3. A composite container as recited in claim 2, wherein said at least one radially projecting rib projects inwardly.

4. A composite container as recited in claim 2, wherein said at least one radially projecting rib projects outwardly.

5. A composite container as recited in claim 1, wherein said curvilinear portion is concave when viewed from a side view.

6. A composite container, comprising:

a tubular body, comprising, at least one body ply formed of a paperboard material and wrapped about a longitudinal axis to form a tubular body wall having a first diameter, said tubular body wall having inner and outer surfaces and opposed first and second ends, a liner ply adhered to the inner surface of said tubular body wall, and a label ply, adhered to at least part of the outer surface of said tubular body wall; and said tubular body defining a curvilinear portion having a diameter that is reduced relative to said first diameter, wherein said curvilinear portion defines at least one axially extending handle defining a maximum handle width at an imaginary cross-sectional plane defined through the tubular body and at least one circumferentially spaced and radially projecting rib defining a rib width at the imaginary cross-sectional plane defined through the tubular body, and wherein the maximum handle width is larger than the rib width at the imaginary cross-sectional plane such that the handle is configured for grasping by a user.

7. A composite container as recited in claim 6, wherein said at least one radially projecting rib projects inwardly.

8. A composite container as recited in claim 6, wherein said at least one radially projecting rib projects outwardly.

9. A composite container as recited in claim 6, wherein said at least one axially extending handle further defines a minimum transition width that is smaller than the maximum handle width thereby defining an undercut portion that is configured for grasping by the user.

* * * * *